US008129644B2

(12) United States Patent
Christensen et al.

(10) Patent No.: US 8,129,644 B2
(45) Date of Patent: Mar. 6, 2012

(54) MOTOR OPERATOR FOR SWITCHGEAR FOR MAINS POWER DISTRIBUTION SYSTEMS

(75) Inventors: Bruno Christensen, Nordborg (DK); Anders Lorenzen, Åbenrå (DK); Verner Smidt, Broager (DK); Jens N. Paulsen, Sønderborg (DK); Glenn Smith, Nottinghamshire (GB)

(73) Assignee: Linak A/S, Nordborg (DK)

( * ) Notice: Subject to any disclaimer, the term of this patent is extended or adjusted under 35 U.S.C. 154(b) by 379 days.

(21) Appl. No.: 12/312,215

(22) PCT Filed: Oct. 31, 2007

(86) PCT No.: PCT/DK2007/000463

§ 371 (c)(1),
(2), (4) Date: Apr. 30, 2009

(87) PCT Pub. No.: WO2008/052548

PCT Pub. Date: May 8, 2008

(65) Prior Publication Data

US 2010/0059482 A1 Mar. 11, 2010

(30) Foreign Application Priority Data

Oct. 31, 2006 (DK) ..... 2006 01404

(51) Int. Cl.
*H01H 3/40* (2006.01)

(52) U.S. Cl. ..... 200/501

(58) Field of Classification Search ..... 200/501, 200/17 R; 307/143; 361/605
See application file for complete search history.

(56) References Cited

U.S. PATENT DOCUMENTS

| | | | | |
|---|---|---|---|---|
| 5,034,584 | A | 7/1991 | Fanta et al. | |
| 5,354,960 | A | 10/1994 | Erickson | |
| 5,895,987 | A * | 4/1999 | Lo et al. | 307/125 |
| 6,951,990 | B1 * | 10/2005 | Miller | 200/50.21 |
| 2009/0314615 | A1 * | 12/2009 | Christensen et al. | 200/17 R |
| 2010/0008022 | A1 * | 1/2010 | Christensen et al. | 361/605 |
| 2010/0046146 | A1 * | 2/2010 | Christensen et al. | 361/605 |

* cited by examiner

*Primary Examiner* — Vanessa Girardi
(74) *Attorney, Agent, or Firm* — Dykema Gossett PLLC

(57) ABSTRACT

A motor operator for switchgear for use in mains power distribution systems comprising a closed cabinet (5) with an operating shaft (53) protruding there from said operating shaft being rotatable at least between two positions and has a coupling part (2). The motor operator (6, 7) comprises a housing mountable on the external surface of the switchgear cabinet. A rotatable connection shaft (51) is connected to an electric motor via a drive mechanism, and has a first coupling part (52) to fit with the coupling part (2) of the switchgear in a non-rotational interlocking manner, and further has a second coupling part (54) extending from the housing to operate the contact of the switch manually and, for which purpose, the motor operator has a release mechanism releasing the connection shaft. The motor and the drive mechanism is designed as an electro-mechanical actuator with a rear mounting (23) for mounting the actuator in the housing of the motor operator and μ. front mounting (29) on the activation element (20) for connection of the activation element to the rotatable connection shaft (51).

13 Claims, 12 Drawing Sheets

MOTOR OPERATOR FOR SWITCHGEAR FOR MAINS POWER DISTRIBUTION SYSTEMS

BACKGROUND OF THE INVENTION

1. Field of the Invention

The invention relates to a motor operator for opening or closing contacts of switchgear adapted for use in mains power distribution systems such as public medium high voltage distribution systems. The motor of the operator may be activated either locally or remotely to open or close the contacts of the switchgear. Alternatively, a drive element normally coupling the motor to the contact operating shaft is selectively removable so that a wrench may be used to manually open and close the contacts in case of failure of the motor operator or as a safety precaution.

2. Description of the Prior Art

Underground or pole mounted electrical transmission and distribution systems include a main service line leading from a sub-station with a number of individual distribution lines along the main line connected thereto. It is often the practice, particularly where power is supplied to a user entity such as a discrete residential area, industrial area or shopping area to provide switchgear in each of the lateral distribution lines connected to the main line in order to allow selective de-energization of the lateral distribution line without the necessity of de-energizing all of the lateral distribution lines. Switchgear conventionally includes electrical, movable contacts which may be opened and closed by maintenance personnel, in case of fault in or maintenance of a distribution line. In a particularly useful type of switchgear, the contacts are mounted under oil or in an inert gas atmosphere.

Generally, the contacts of switchgear require snap action opening and closing mechanisms to minimize arcing and assure a positive closing of the contacts. Actuation of the switch operating mechanism has normally been accomplished manually requiring service personal to locate and travel to the switchgear in question. Recently, there has been increased interest in switch contact actuating mechanisms that is motor operated and can be activated at remote locations as well as manually locally. In some cases motor operators have been installed within the switchgear cabinet itself for powered actuation of the opening and closing mechanism. By design, these motor operators are not suitable for installation on a retrofit basis on an external side of an existing switchgear cabinet. Moreover, most of the available motor gear operators are relatively expensive, both in terms of cost for various components as well as expenses for installation of the same. Furthermore, these motor operators do not readily lend themselves to manual actuation in the event of motor failure or in the event the operator desires to open the switch contacts by hand.

As a consequence of the fact that it is almost impossible to incorporate a motor operator in a switchgear cabinet, there is an increased interest in motor operators that could be mounted externally to the cabinet of the switchgear. In this respect it should be noted that it is not allowed to make any holes in the cabinet or make any weldings, which renders the mounting very difficult. It should also be considered that in most cases the motor operator should not only be weather proof but also secured against unauthorized intrusion. Further, it should be fully operable under all weather conditions and operate in a reliable manner.

An example of a motor operator to be mounted externally on a switch gear is dealt with in U.S. Pat. No. 4, 804, 809, said motor operator may even be mounted as a retrofit unit. The motor operator is composed of an assembly of individual elements mounted in a housing necessitating a tedious dismounting of the connection between the motor operator and the switchgear for manually operating the switchgear. Further, the motor operator has to be designed for each individual type of switchgear. This renders the motor operator costly.

Hence, there is a need for a motor operator which overcomes these and other problems associated with known devices.

SUMMERY OF THE INVENTION

It is an object of the present invention to provide a motor operator which is easy to mount and maintain and it is a further object that it should be easy to operate manually and an even further object is that the motor operator could easily be disabled from the switchgear.

According to the invention the motor and the drive mechanism is designed as an electro-mechanical actuator with a rear mounting for mounting the actuator in the housing and with an activation element having a front mounting for connection of said activation element to the rotatable shaft. Accordingly this provides a magnificent freedom in designing the motor operator first of all because the connection shaft and the drive mechanism are now two separate parts, i.e. the various types of connection shafts and drive mechanism can be combined according to demand. The construction of the motor operator is also simplified as there are only two main components to be installed in the housing which also provides the opportunity of a more neatly arranged and more accessible interior of the housing. This also accomplishes that the housing could be made in a better weather and vandal proof quality. A further advantage is that the motor operator is more maintenance friendly. In case of a fault on the drive mechanism it could swiftly be replaced with a new one. Afterwards the broken or malfunctioning drive mechanism could be repaired and tested in a comfortable manner. Realizing that the drive mechanism could be designed as an electro-mechanical actuator, it is seen that some exiting actuator on the market might be used directly or with some modifications making the motor operator even more cost friendly.

According to an embodiment of the invention, the electro-mechanical actuator is a linear actuator, i.e. an actuator with an activation element that performs a linear movement. The linear actuator preferably comprises a spindle with external threads and a spindle nut arranged thereon in a non-rotational manner and that the activation element is a tube shaped element attached to the spindle nut. This has proven to be a reliable, compact, easy to install and inexpensive construction.

In a preferred embodiment of the invention, a release mechanism is build into the actuator decoupling the activation element from the motor and transmission thereby allowing the activation element to be moved manually. Accordingly when activating the release mechanism it is without further notice possible to operate the switchgear manually e.g. by means of a wrench. However in an embodiment of invention the existing switchgear handle could be used. The release mechanism also posses the inherit property that even in case the motor unintentionally is operated then it is unable to operate the switchgear. This release mechanism could also be deployed to test the drive mechanism of the actuator to see if it works properly.

In an embodiment according to the invention the release mechanism comprises a gear wheel in a gear train between the motor and the activation element and said gear wheel is arranged displaceable along its rotational axis between a first position, in engagement with the gear train, and a second position, out of engagement with the gear train, thereby releasing the spindle from the motor, which is a simple and reliable construction.

According to an embodiment the gear wheel could be displaced by means of an eccentric on a swivel axis in contact with one side of the gear wheel. The gear wheel is being spring loaded into the engaging position in the gear train and the eccentric could function as rest for the gear wheel in that position. When swivelling the eccentric the gear wheel is displaced out of engagement with the gear train.

For activation of the release mechanism the swivel axis is connected with a turnable knob on the outside of the housing, which renders the operation of the release mechanism readily accessible.

When the contacts of the switchgear are in off-position i.e. the mains is cut-off, there is a need for earthing the switchgear more specifically the cable section which has been cut-off. In an embodiment of the motor operator, the turnable knob of the release mechanism is via a wire connected to a locking mechanism barring the earthing contacts when the release mechanism is in its resting position and unbarring the earthing contacts when the release mechanism is activated, allowing operation of earthing contacts. Thereby it is secured that the earthing contacts cannot inadvertently be activated when the contacts of the switchgear are in on position.

In some types of switchgear the earthing is accomplished through the operating shaft. Accordingly, in a further embodiment, the second coupling part could, for manually operation, be released from the drive line to the actuator. In a further embodiment of the invention the turnable knob is, via a wire, connected to a locking mechanism for the rotatable connection shaft. As the rotatable connection shaft communicates with the operating shaft this also prevents inadvertently activation of the earthing.

In a still further embodiment a sensor is present, said sensor detects the position of the earthing contact. Appropriately the sensor is arranged such that a signal is sent to the control equipment when earthing is barred and in case the control equipment receives no signal from the sensor this indicates that the earthing contacts are unbarred for operation. The motor operator then is not allowed to run.

To ensure that only authorized attendants can operate the switchgear, the turnable knob could be locked by means of a pad lock through a hole in the turnable knob and a mating hole in a member fixed on the housing. This is a simple and reliable manner to secure the system.

Accordingly it would be understood that the overall size of the motor operator could be relatively compact and may be readily mounted also as a retrofit unit on the external side of an existing switchgear cabinet.

Further, the invention relates to a method for operating a switchgear. When the release mechanism for the motor operator is disabled, then the switchgear can only be changed by means of the motor operator, namely between the on-position and the off-position and vise versa, thereby securing against improper operation of the switchgear, especially securing against unintentional earthing of the switchgear. When the release mechanism for the motor operator is activated, then the switchgear can only be operated manually, namely between the on-position, the off-position and the earthing-position and vise versa. This secures likewise against improper operation of the switchgear.

DETAILED DESCRIPTION OF THE DRAWINGS

Figure 1:
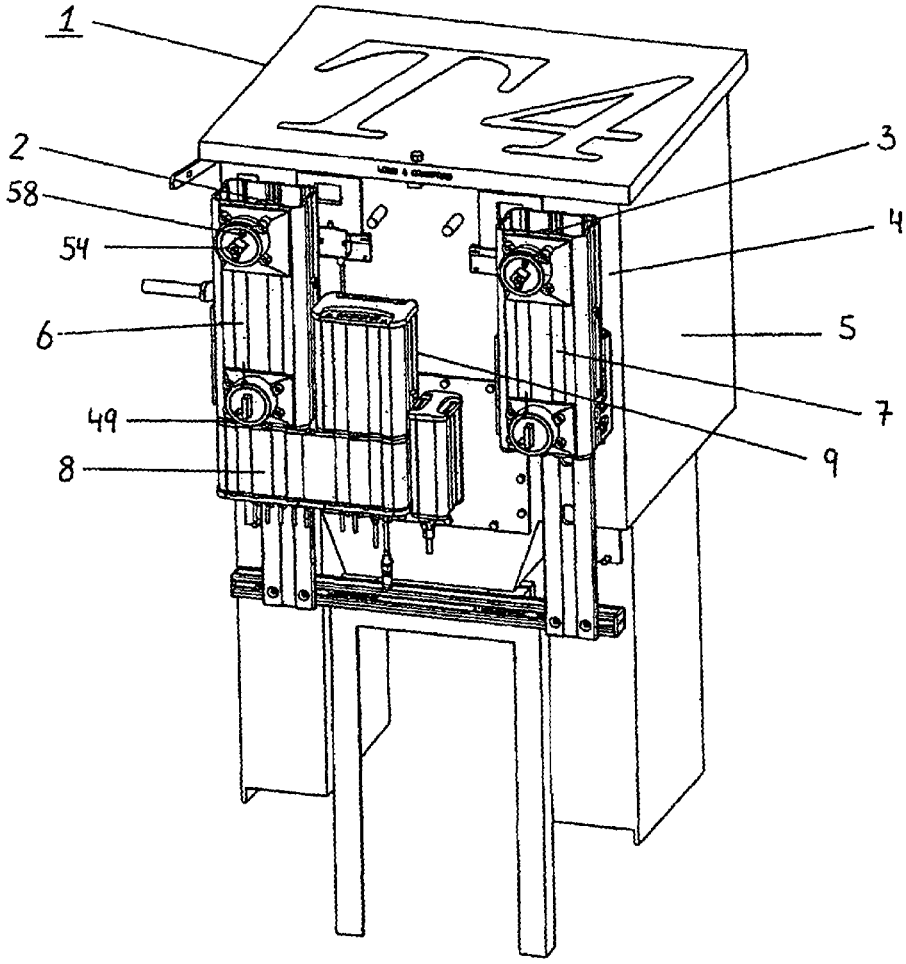
FIG. 1 is a perspective view of a switchgear seen from the front.

FIG. 1 shows a switchgear 1 with two sets of electric contacts operated by a rotary shaft ending in a dog 2,3 at the front side 4 of the cabinet 5 of the switchgear. The electric contacts are controlled by respective motor operators 6,7. As the motor operators basically are identical, only one is described in the following. The motor, operator 6 on the left hand side of the switchgear is built together with a control unit 8 and a rechargeable battery package 9 which is common for the two motor operators.

Figure 2:
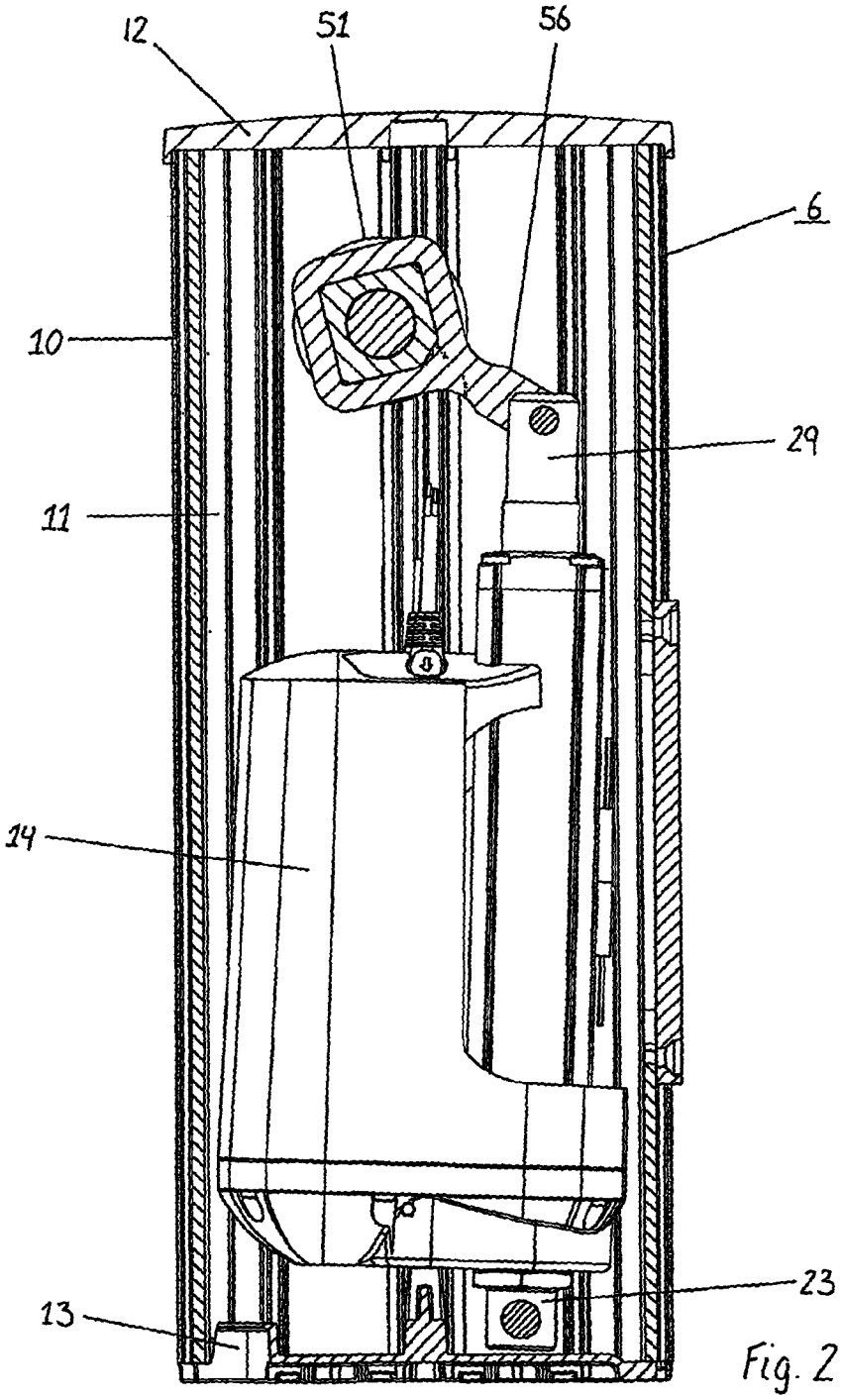
FIG. 2 is a longitudinal section through a motor operator for the switchgear.

Referring to FIG. 2 the motor operator 6 comprises a housing 10 in the nature of an extruded aluminum tube 11 with a top end and bottom end closure 12, 13 (not shown in FIG. 1). The end closures are fixed to the aluminum tube 11 by means of screws received in screw channels in the tube.

Figure 3:
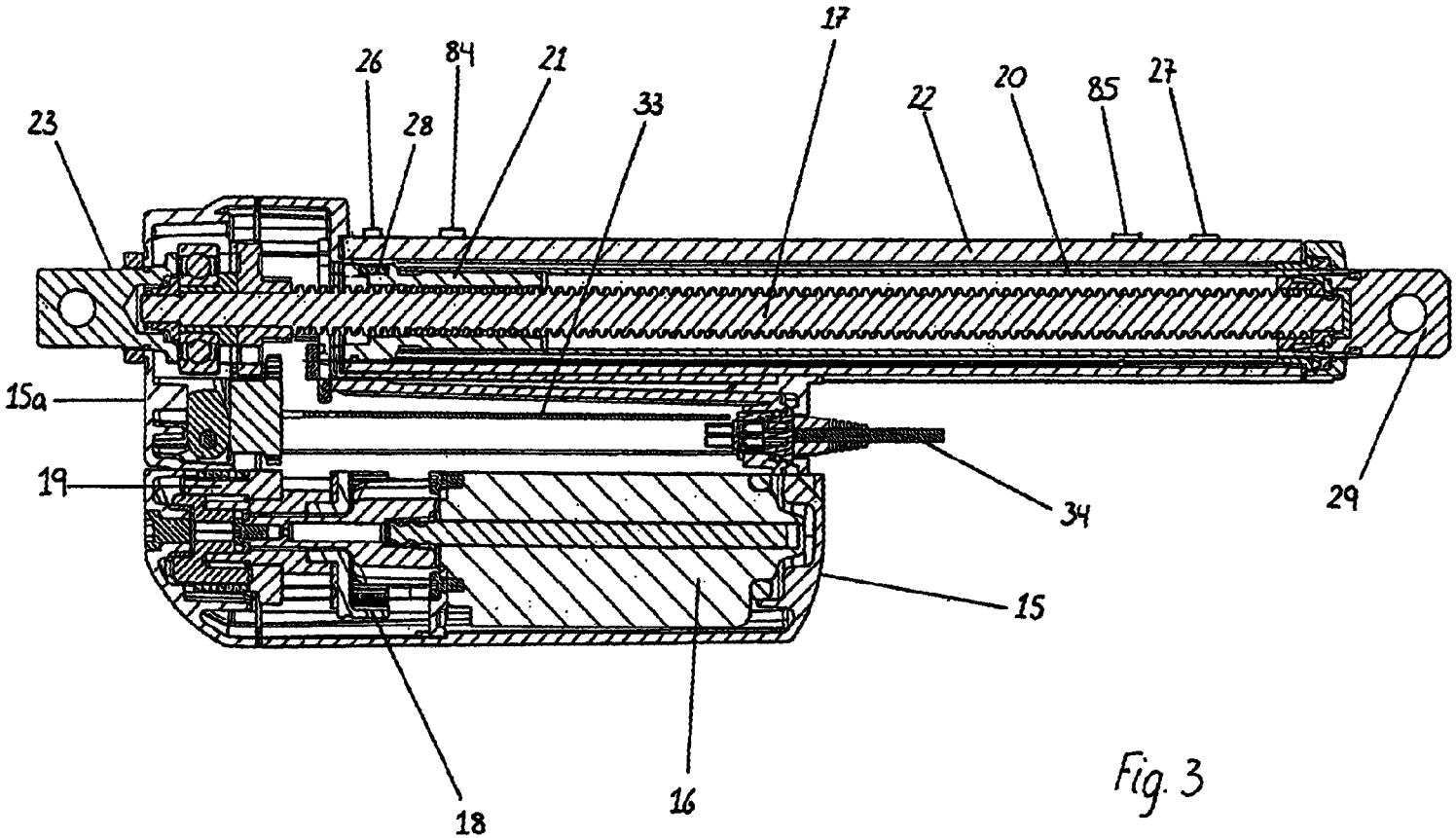
FIG. 3 is a longitudinal section through a linear actuator of the motor operator.
Figure 4:
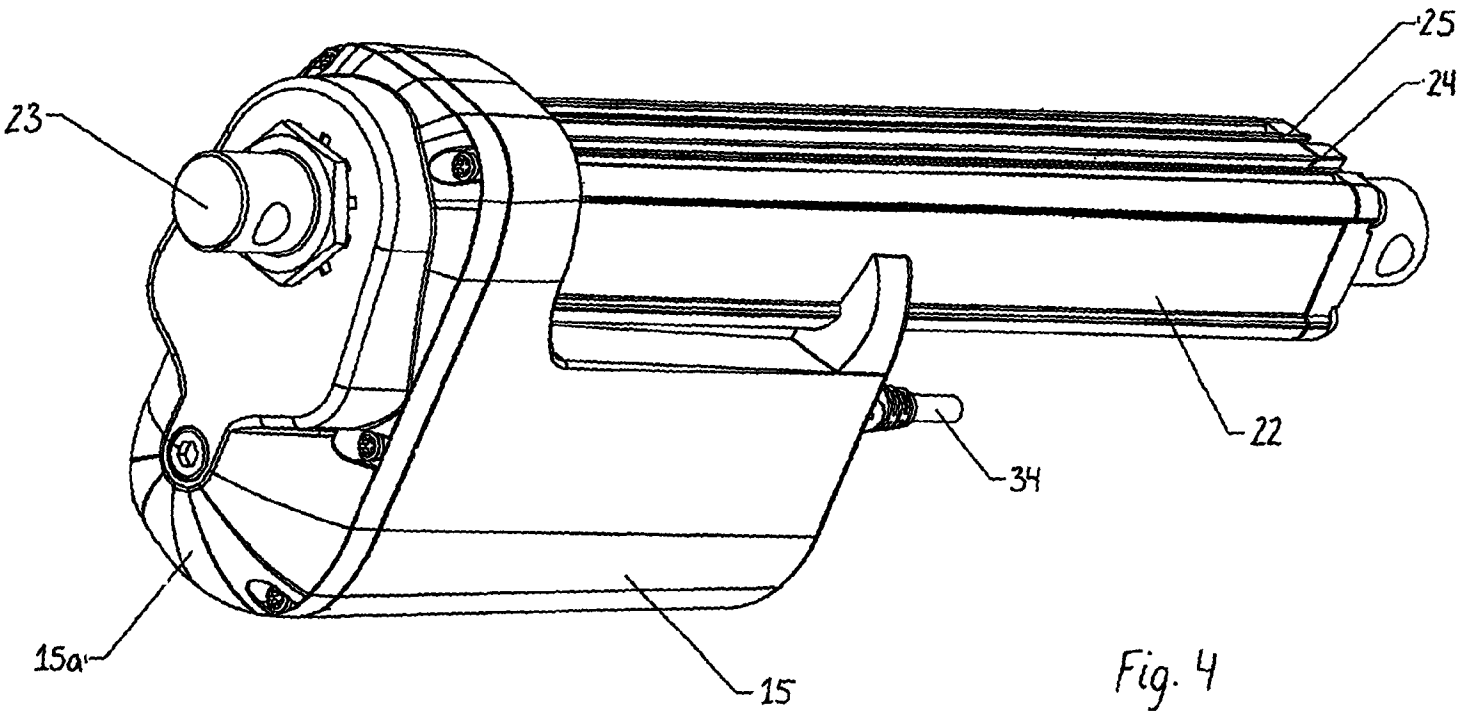
FIG. 4 is a perspective view of the linear actuator seen from the rear end.

In the housing 10 a linear actuator 14 is located. Referring how to FIG. 3, the actuator comprises an enclosure 15 with a reversible electric motor 16 driving a spindle 17 through a multiple stage step down gear. The step down gear comprises a planetary gear 18 and a gear train 19. An activation element 20 in the nature of a tubular piston is attached to a spindle nut 21 located on the spindle 17. The activation element 20 is telescopically located in a protective and guiding tube 22. The actuator has a rear mounting 23 for mounting in the housing 10 of the motor operator. A shaft extends through an eye in the rear mounting 23 and the end of the shaft is attached to the sidewalls of the housing. Distance bushings are provided to centre the actuator.

The enclosure 15 of the linear actuator, which is made of moulded aluminium for strength purposes, has an end cover 15*a* which is mounted with screws, and the joint is more-over water-tight. The guide tube 22 is an extruded aluminium tube having an essentially square cross-section. On one side, the guide tube 22 is provided with two longitudinal grooves 24,25, one of which is used for mounting external end stop switches 26,27. The end stop switches are Reed switches which are triggered by a magnet 28 carried by the spindle nut 21. Accordingly, the stroke of the actuator can easily be adjusted by moving the end stop switches. A front mounting 29, here a fork mounting with an eye, is secured in the end of the activation element.

Figure 5:
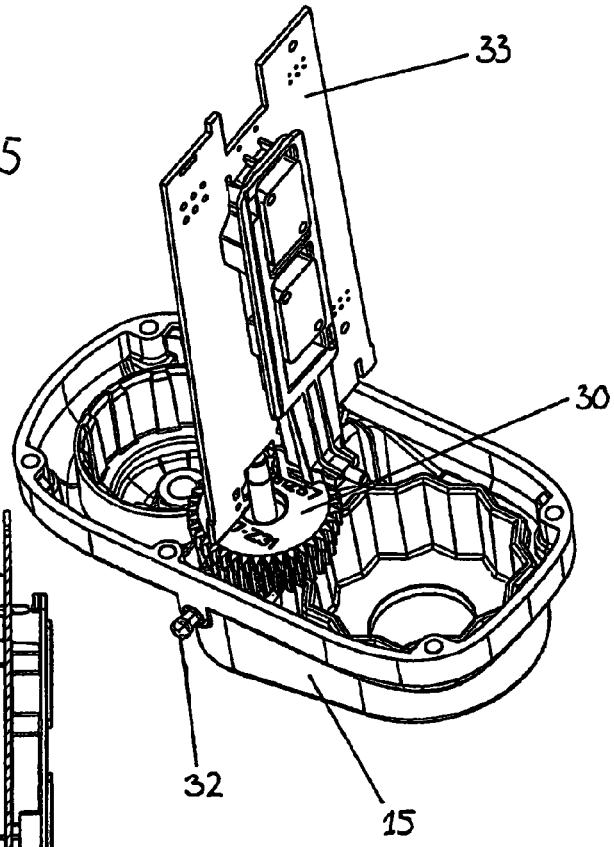
FIG. 5 is an end cover in a perspective view of the enclosure of the linear actuator seen from the inside of the actuator.
Figure 6:
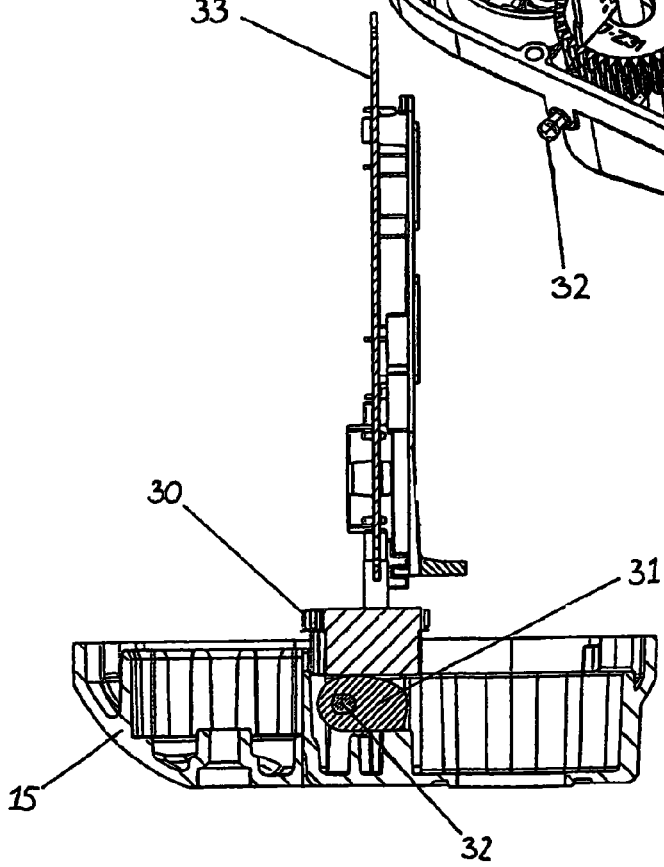
FIG. 6 is a cross section of the end cover.
Figure 7:
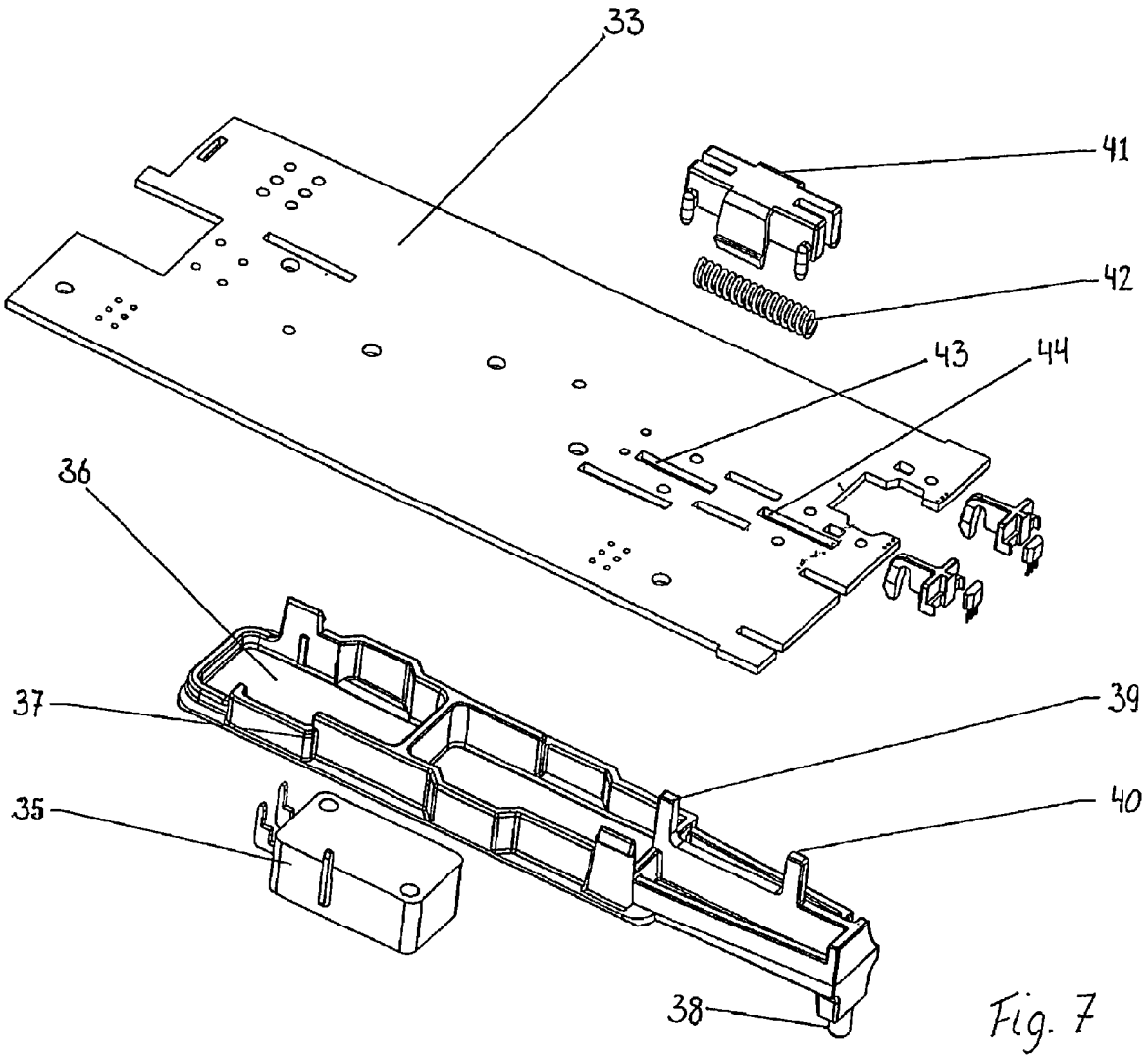
FIG. 7 is a circuit board inside the actuator shown in an exploded view.
Figure 8:
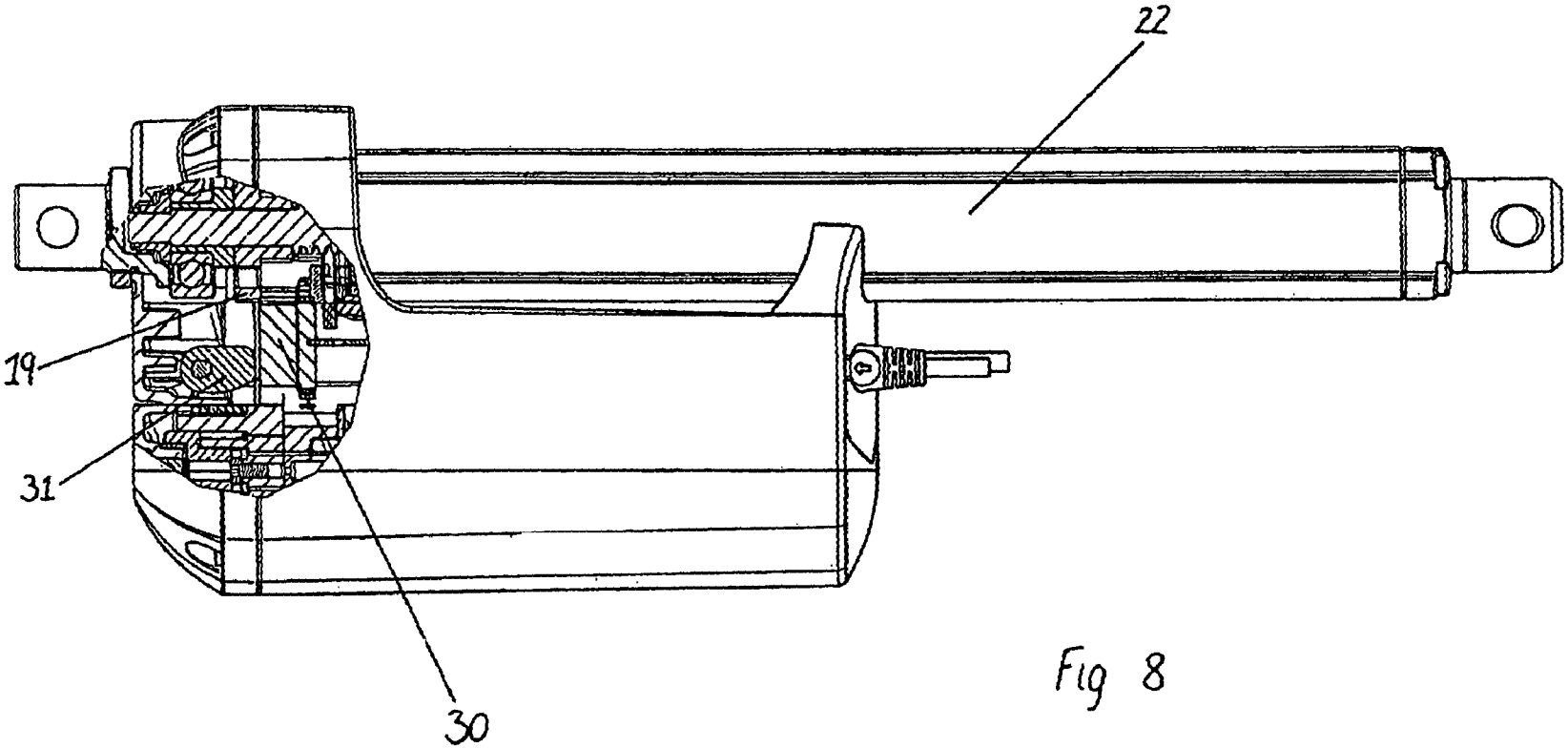
FIG. 8 is the linear actuator seen from one side where a part of the closure is removed at the rear end.

In FIGS. 5 and 6 the end cover 15*a* of the enclosure 15 is shown in greater detail. Among others a gear wheel 30 is shown following the planetary gear 18. The gear wheel 30 is arranged displaceable along its axis. The displacement can be effected with an eccentric 31 on a swivel axis 32 emerging from the end cover 15*a* at 33. When displaced the gear wheel 30 disengages the gear train and accordingly the spindle 17 is decoupled from the motor 16 and the planetary gear 18 and thus the activation element 20 can be driven manually by applying an axial force as the spindle 17 is free to rotate, c.f. FIG. 8. The gear wheel 30 and eccentric 31 on swivel axis 32 constitute a release mechanism.

Referring to FIG. 6 a printed circuit board 33 with all the components and circuits necessary for the control of the actuator is inserted into the enclosure 15 along the motor 16 (FIG. 3). The printed circuit, board 33 is arranged such that the actuator may run on a DC as well as an AC power supply positioned outside, the actuator. A bridge having four FET transistors is used for reversing the direction of rotation of the motor and thereby expelling or retracting the activation rod depending on the direction of rotation. The printed circuit board extends to the front end of the enclosure 15 which has a gate at each side for a cable 34 (FIG. 3). In connection with the gates, the printed circuit board has a socket for the cables. One cable is a power supply cable, while the other is a control cable for a PLC control in the control unit 8. On the circuit board 33 a switch 35 is arranged. A sliding element 37 is arranged around the switch, which is rectangular, the slide element being provided with a frame-shaped opening 36 which guide on the sides of the switch 35, and which activate this in specific positions. The slide has an angular leg 38 which extends down behind the displaceable gear wheel 30. When the gear wheel is displaced, it hits the leg 38 and pushes the slide 37 to activate the switch 35, signalling to the control unit that the release mechanism has been activated. The slide element 37 is kept in a neutral position in that it has two fingers 39,40 which extend through respective slots 43,44 in the printed circuit board, on whose other side an elongate housing 41 is mounted, in which a slightly pre-biased helical spring 42 is mounted between the ends. A slot is provided at both ends of the housing for the fingers 39,40 of the slide element which engage the ends of the spring 42. The slide element 37 is thereby kept in a neutral position by a single helical spring 42. When the slide element 37 is moved towards the rear end of the actuator, the spring 42 is compressed against the rear end of the housing by the finger 40 farthest off at the front end of the actuator, while the finger 39 farthest off at the rear end of the actuator is displaced in its slot away from the housing 41. When deactivating the eccentric 31, the gear wheel 30 is reintroduced by a spring into engagement with the gear train. As a consequence, the slide element 37 assumes its original position. The spring tension ensures that the slide element 37 assumes a neutral position, and since the spring 42 is biased, the neutral position is determined uniquely. Accordingly, it is assured that the power to the motor 16 is cut off when the spindle 17 is disengaged for manual operation.

Figure 9:
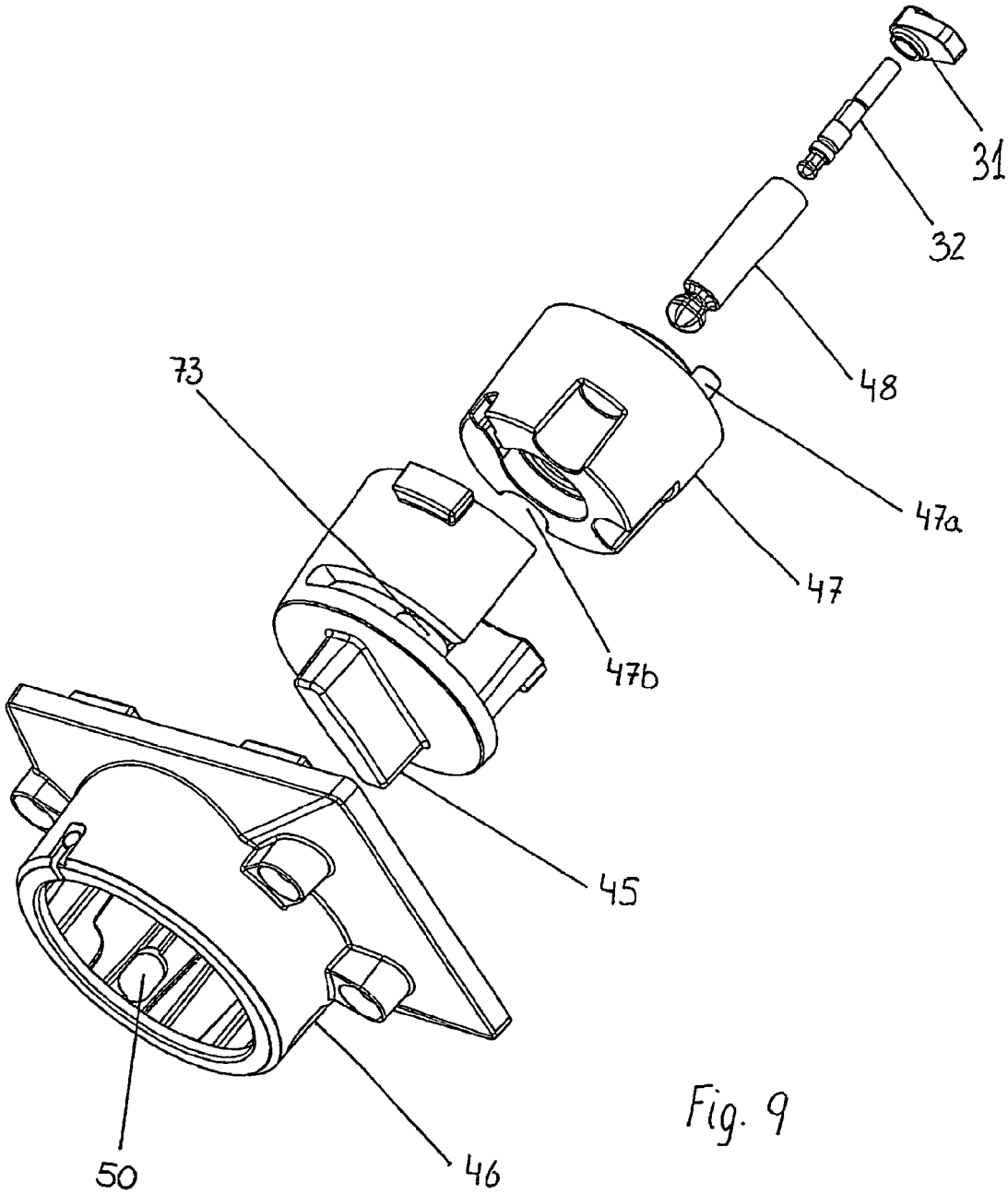
FIG. 9 is an exploded view of a knob for operating a release mechanism in the linear actuator.

As it is apparent from FIG. 9, the release, mechanism can be operated by a turnable knob 45 on the front side of the housing 10 of the motor operator. The knob 45 is rests in a base 46 mounted on the housing 10 by screws. The knob 45 is hollow for receiving an insert 47 locked to the housing by a protrusion 47*a* fitting into a hole on the front side of the housing. A central portion 73 of the knob is received in a recess oh the upper side of the insert, the length of which is shorter than the length of the hollow of the knob 45, leaving a gap between the upper side of the insert and the knob for a wire to be explained in the following. A connection shaft 48 connects the knob 45 to the swivel axle 32 of the eccentric 31. When turning the knob 45, the release mechanism is activated as previously described. The knob 45 could be barred with a pad-lock for which purpose the knob is having a through hole 49 (FIG. 1) on the front side mating with a hole 50 in the base 46 via a recess 47*b* in the insert 47. when the pad-lock is inserted, the knob 45 is locked to the base, securing that only authorized attendants can operated the release mechanism.

Figure 10:
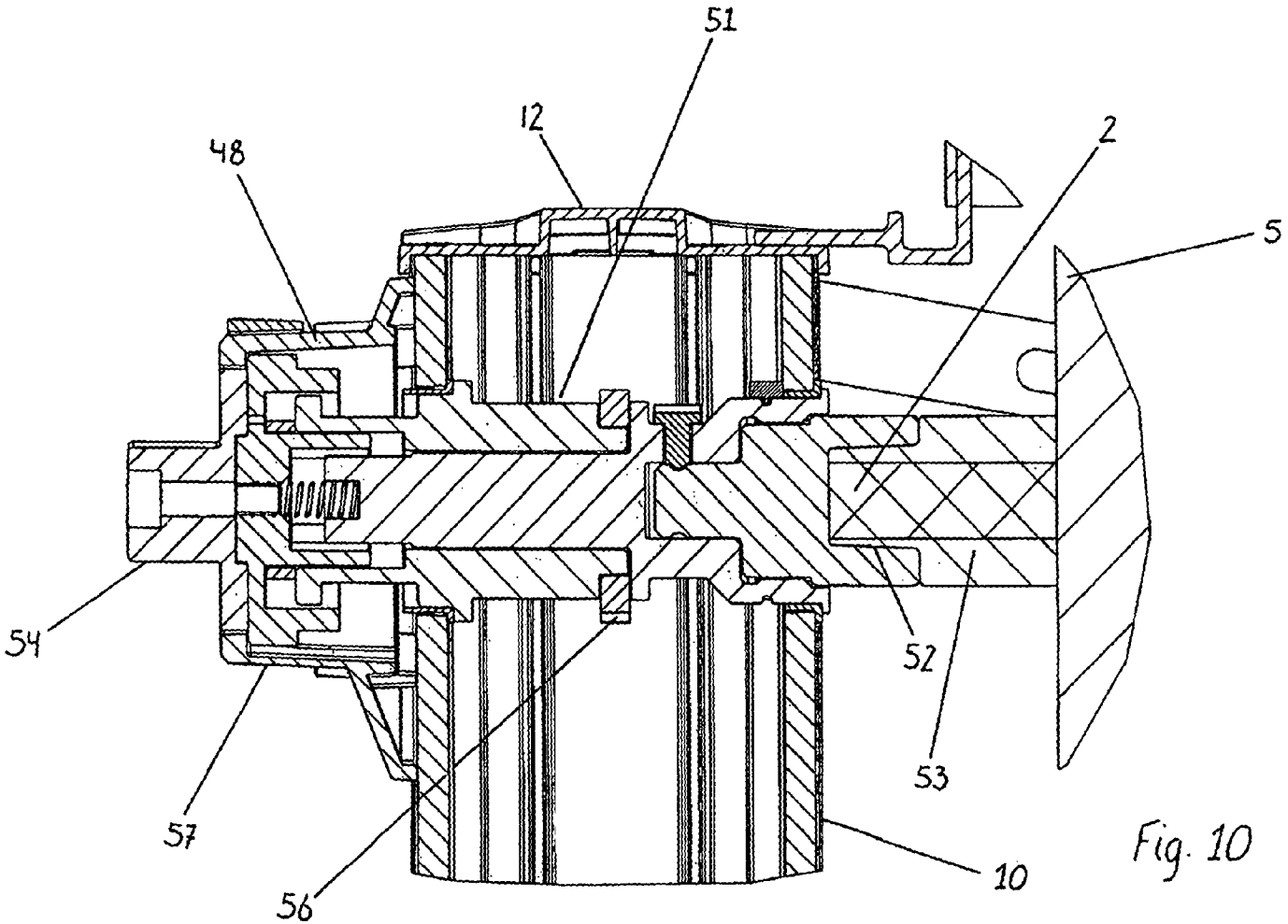
FIG. 10 is an enlarged cross section of the upper part of the motor showing the connection operator to the operating shaft of the contacts of the switch gear.

Now referring to FIG. 10, at the upper end of the motor operator housing 10 a connection shaft 51 is arranged. The end of the connection shaft 51 facing the switchgear is designed with a first coupling part in the form of a socket 52 fitting the dog 2 at the end of the shaft 53 operating the contacts within the switchgear. The socket 52 is in a horizontal movement slid over the dog 2 and the socket and the dog are thereby interconnected. The end of the connection shaft 51 protrudes from the housing 10 and is fitted with a second coupling part in the form of a dog member 54 for manual operation with a handle when the release mechanism of the actuator is activated. The dog member 54 is designed as the dog member 2 on the switchgear, thus the existing switchgear handle could be used. The dog member 54 rests in a base 57 mounted on the housing 10 by means of screws. On the connection shaft 51 a lever arm 56 is mounted, the free end of which is attached to the front mounting 29 of the linear actuator. When the front mounting 29 is expelled, the connections shaft 51 would thus rotate the dog 2, operating the contacts of the switchgear.

The dog member 54 is also located in a base 57 which could be mounted on the housing 10 by means of screws. The dog member 54 has a hole 58 for a pad lock on the front side mating with a hole in the base 57. When a pad-lock is inserted into the holes in the dog member 54 and the base 57, the dog member 54 is barred, thereby preventing the switchgear from being operated manually. It should be understood that in this situation the motor operator could neither operate automatically as the power to the linear actuator 14 is interrupted, preventing the motor operator from inadvertently being operated.

Figure 11:
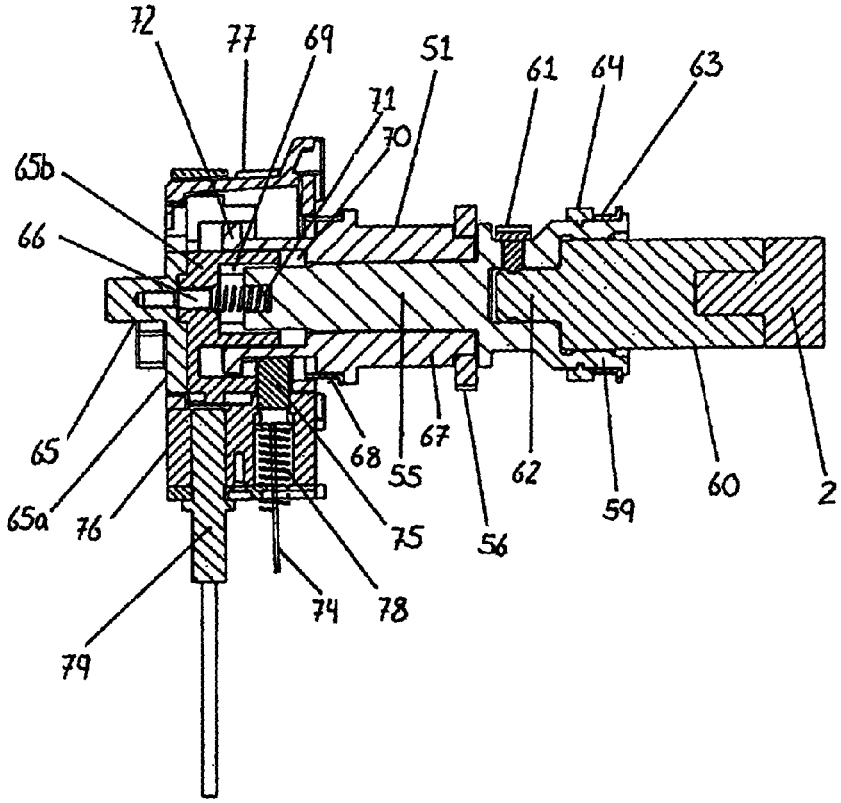
FIG. 11 is a cross section through the connection shaft and the operation knob for the release mechanism.
Figure 11:
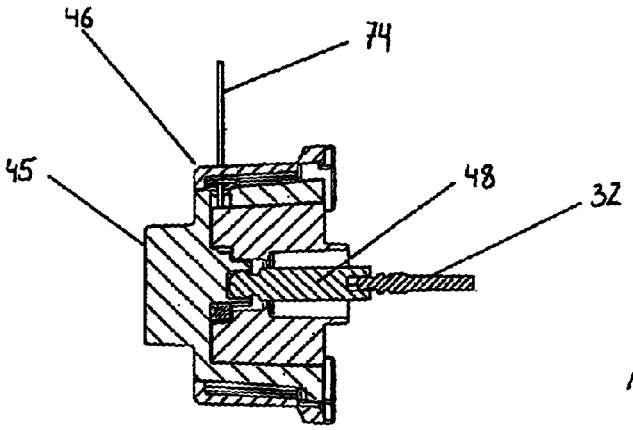

In FIG. 11 there a slightly different construction of the connection shaft shown compared to that in FIG. 10. However, the following is common for the two constructions, namely an axle 55 having a socket 59 for receiving an interchangeable socket member 60 for the dog 2 from the switchgear. The dog from the switchgear could have different shapes depending on the actual switchgear in question. For this purpose the socket member 60 could be exchanged with a socket member having socket mating the dog of the switch gear. The external surface of dog member 60 and the internal, surface of the socket 59 of the axle have non-rotational interlocking means such as a spline or a fine longitudinal toothing. The interchangeable socket member 60 is kept in position in the longitudinal direction by a screw 61 in the axle 55 entering into a groove in a step down portion 62 of the socket member 60. 63 is a bushing to be inserted in a hole in the sidewall of the housing 10 and kept in position by a locking ring 64. The outer end of the axle 55 has a square cross section received in the dog member 65, which is different from the dog member 54 in FIG. 10. The dog member 65 comprises two parts, namely an outer part 65*a* attached to an inner part 65*b* by means of a screw 66 inserted from the hollow of the inner part 65*b* and a rib and recess in the respective parts locks the two parts inter-rotationally. Around the axis there is a tube shaped axle 67 carrying the lever arm 56 connected to the linear actuator, c.f. FIG. 2. The lever arm 56 has a square opening receiving a square portion at the end of the tube shaped axle 67, the outer end of which is guided in a bushing 68 located in a hole in the outer wall of the housing 10. The outer end of the of the axle 55 also has a square cross section received in a mating hole 69 of the member 65*b* of the dog member 65. The member 65*b* is with a tubular portion guided in a hole 70 of the tube shaped axle 67. The knob 65 is biased into its outermost position by a spring 71, where it is retained against a shoulder in the base. A pair of flanges 72 of the tube shaped axle 67 engage a pair of flanges in the knob 65, more specifically the part 65*a* of the knob. When the actuator is activated, the lever arm 56 will rotate the tube shaped axle 67, thereby also rotating the part 65*a* of the knob. As the latter is fixed with its other part 65*b*, the axle 55 would also rotate and thereby rotate the dog 2 of the switchgear and accordingly change the position of the contacts to either the off- or on-position depending on the direction of rotation.

Figure 12:
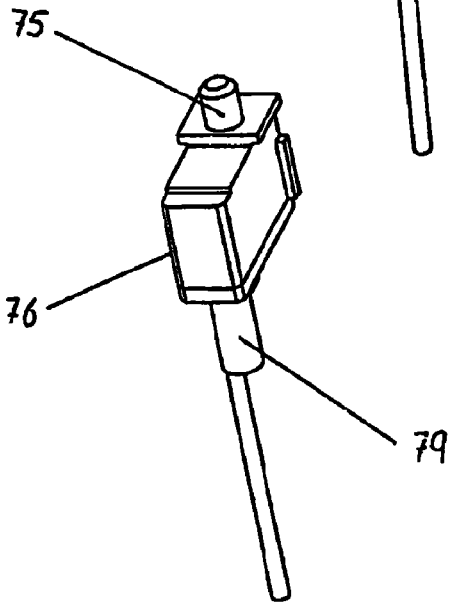
FIG. 12 is a barring device for a earthing operator.

In the switchgear besides from the on/off positions a third position is required, namely earthing as previously explained. In the embodiment indicated in FIG. 11 this is brought about by urging the knob 65 inwards until the flanges 72 of the tube shaped shaft 67 disengages from the flanges of the knob 65 and thus the knob is disengaged from the tube shaped axle 67 and thereby also disengaged from the linear actuator. The knob 65 could then be operated by a handle rotating the dog 2 of the switchgear and thereby close the earthing contact. However, being able to, perform the earthing, the release mechanism 30-32 of the actuator has to be activated, which is done by turning the knob 45 as earlier described, c.f. FIG. 9. To a central portion 73 of the knob 45 a wire 74 is, via a slot, attached going through a hole in the sidewall of the base 46. The wire 74 is connected with a latch bolt 75 in an annex housing 76 of the base 77 for the knob 65, c.f. FIG. 12. The latch bolt 75 is by means of a spring urged into a cavity in the tube shaped axle 67 and thereby preventing it from rotating. Only when the release mechanism is activated can the connection shaft 51 be operated manually. A further precaution is made to secure against mal-operation, namely by means of an inductive sensor 79 located next to the latching bolt 75. The inductive sensor 79 senses on a flange on the potion 65*b* of the knob 65. The flange has a stepped down portion located such that when the connection shaft is turned to the earthing position then the inductive sensor no longer is triggered and no signal is received by the control unit indicating that the switchgear ready for earthing.

Figure 13:
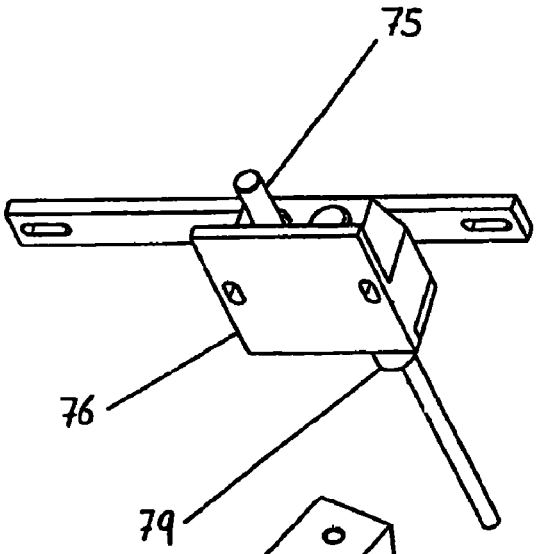
FIG. 13 is another embodiment of a barring, device for a earthing operator.
Figure 14:
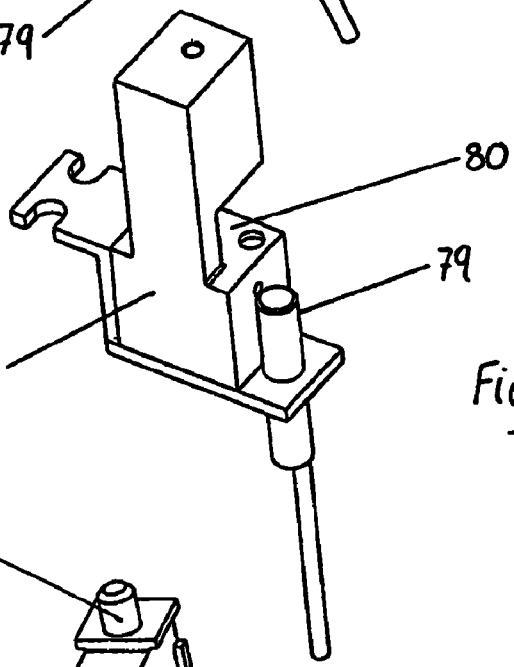
FIG. 14 is a further embodiment of a barring, device for a earthing operator.

The connection shaft 51 shown in FIG. 10 is for a different type of switchgear, namely switchgear where the earthing is locked by a separate sliding latch bar which could be moved between a first position, preventing earthing, and a second position allowing earthing by turning the connection shaft 51 further. The annex housing 76 with the latch bolt 75 and the sensor could lock the slide bar in a similar manner as described above, c.f. the embodiment shown in FIG. 13. A different embodiment is shown in FIG. 14 where a latch bar extends through an incision 80 in the annex housing and the latch bar is placed in connection with this incision. In the two latter cases in the barred position the sensor senses on the latch bar however, when moved to the position allowing earthing, a hole in the sliding latch bar is located in front of the sensor and accordingly, the control unit no longer receives a signal indication that the switchgear is prepared for earthing.

Figure 15:
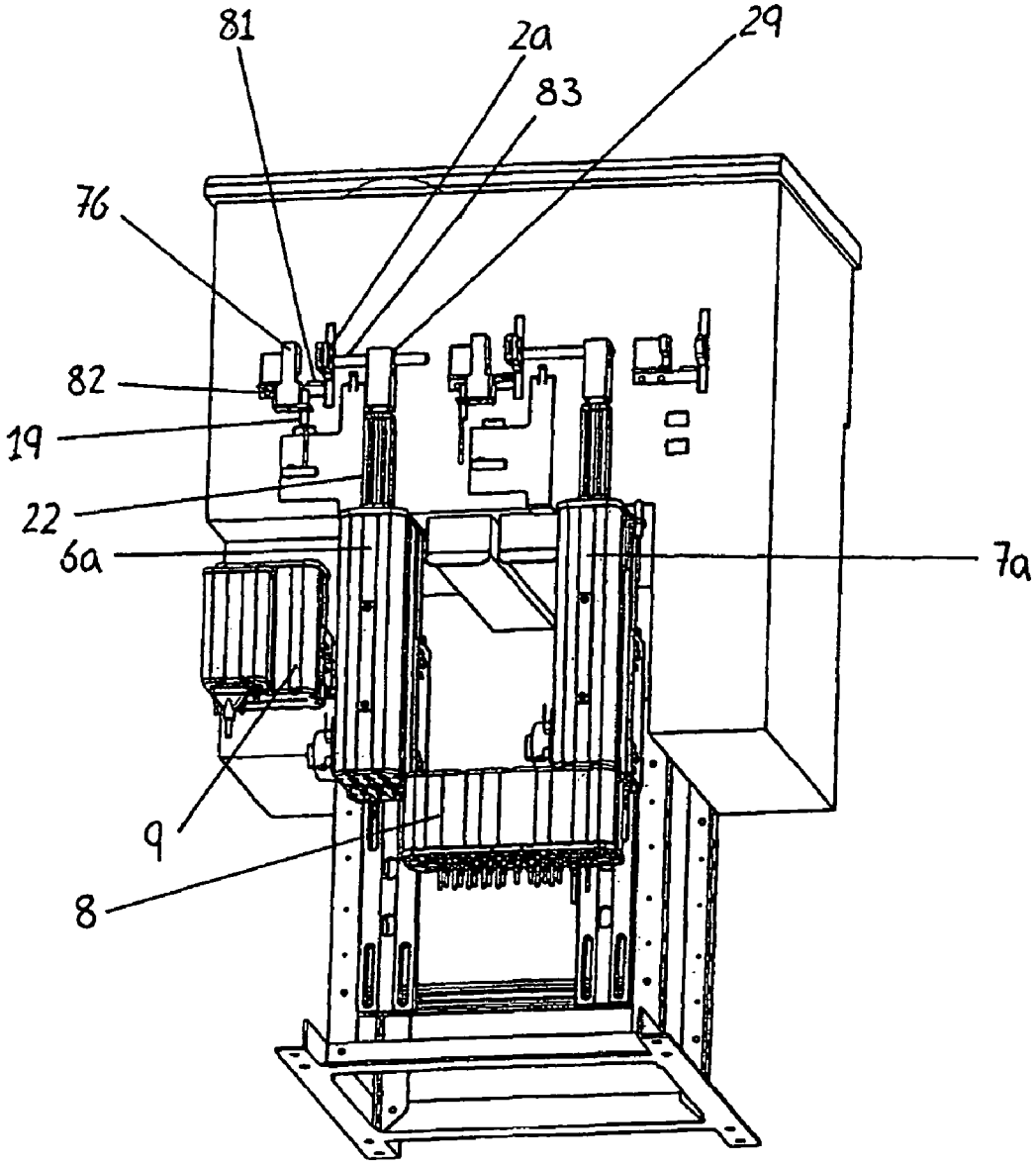
FIG. 15 is a perspective view of different type of switchgear seen from the front.

FIG. 15 shows the type of switchgear referred to above where the earthing is locked by a separate sliding latch bar 81 equipped with the embodiment of the inductive sensor shown in FIG. 14. The two half circular notches 82 is for barring the latch bar 81 as at least one of the notches 82 is matting a hole in V-shaped bracket carrying the latch bar 81. The switchgear is of the type where the operating shaft with the coupling part 2*a* is rotatable about a horizontal axis. The coupling part is with a rod 83 connected to the activation member 29 of the linear actuator the guide tube 22 of which extends through an opening in the top cover of the housing 10.

As previously mentioned the linear actuator has two end-stop switches 26,27. However, the actuator is equipped with two further switches 84,85 preferably of the latch type connected to the control unit 8 for indicating the position of the activation element 29 and thereby indicating whether the switchgear is in its on- or off-position. However, the two switches also indicate if the activation element 29 is in a position between the on- and off-positions, e.g. having left the switch 84 but not reached the switch 85 indicating a fault.

The invention claimed is:

1. A motor operator for switchgear mains power distribution systems, said switchgear comprising a closed cabinet with an operating shaft protruding there from, said operating shaft being rotatable at least between two positions and has a coupling part, said motor operator comprising a housing mountable in front of the switchgear cabinet, a rotatable connection shaft connected to an electric motor via a drive mechanism, and has a first coupling part to fit with the coupling part of the switchgear in a non-rotational interlocking manner, and further has a second coupling part accessible from outside of the housing to operate the switchgear manually and for which purpose the motor operator has a release mechanism releasing the connection shaft from the electric motor for manually operations, wherein the motor and the drive mechanism comprise:

a linear actuator with a rear mounting for mounting in the housing of the motor operator, a front mounting on a tube-shaped activation element for connection to the rotatable connection shaft, a spindle with external threads, and a spindle nut arranged on the spindle in a non-rotational manner, the activation element being attached to the spindle nut.

2. The motor operator according to claim 1, wherein a second coupling part for manually operation can be released from the drive line to the actuator.

3. The motor operator according to claim 2, wherein second coupling part can only be released when the quick release of the actuator also has been activated.

4. The motor operator according to claim 1, wherein the release mechanism is built into the actuator.

5. The motor operator according to claim 4, including a switch in connection with the release mechanism for cutting off the power to the motor when the release mechanism is activated.

6. The motor operator according to claim 5, wherein the switch for cutting off the power to the motor is operated by the displaceable gear wheel.

7. The motor operator according to claim 4, including a gear train between the motor and the activation element and a gear wheel in the gear train arranged displaceable along a rotational axis thereof between a first position in engagement with the gear train and a second position out of the engagement with the gear train, thereby releasing the spindle from the motor.

8. The motor operator according to claim 7, including an eccentric on a swivel axis in contact with one side of the gear wheel for displacement of the gear wheel, said gear wheel being spring loaded into an engaging position.

9. The motor operator according to claim 8, wherein the swivel axis is connected with a turnable knob on the outside of the housing to operate the eccentric.

10. The motor operator according to claim 9, wherein the turnable knob, via a wire, is connected to a locking mechanism for the rotatable connection shaft.

11. The motor operator according to claim 9, wherein the turnable knob, via a wire, is connected to a locking mechanism barring an earthing contact.

12. The motor operator according to claim 11, including a sensor to detect a position of the earthing contact.

13. The motor operator according to claim 11, wherein the turnable knob can be locked by means of a pad lock through a hole in the turnable knob and a mating hole in a member fixed on the housing.

* * * * *